US006132269A

United States Patent [19]

Belt

[11] Patent Number: 6,132,269

[45] Date of Patent: Oct. 17, 2000

[54] CANTILEVER JET DRIVE PACKAGE

[75] Inventor: Fletcher C. Belt, Woodstock, Ill.

[73] Assignee: Outboard Marine Corporation, Waukegan, Ill.

[21] Appl. No.: 09/265,075

[22] Filed: Mar. 9, 1999

[51] Int. Cl.[7] ..... B63H 11/00

[52] U.S. Cl. ..... 440/38; 440/111

[58] Field of Search ..... 440/111, 112, 440/38, 61, 52; 114/55.5

[56] References Cited

U.S. PATENT DOCUMENTS

| | | | |
|---|---|---|---|
| 2,064,463 | 12/1936 | Crosley, Jr. | 115/34 |
| 3,083,679 | 4/1963 | Conover | 115/34 |
| 3,170,435 | 2/1965 | Najimian, Jr. | 440/112 |
| 3,259,099 | 7/1966 | Kiekhaefer | 115/34 |
| 3,583,357 | 6/1971 | Shimanckas | 115/41 |
| 3,834,344 | 9/1974 | Yoshino | 115/34 R |
| 3,929,089 | 12/1975 | Lambrecht et al. | 115/41 HT |
| 5,490,768 | 2/1996 | Veronesi et al. | 440/38 |
| 5,536,187 | 7/1996 | Nanami | 440/38 |

*Primary Examiner*—Ed Swinehart
*Attorney, Agent, or Firm*—John H. Pilarski; Dennis M. Flaherty

[57] ABSTRACT

A marine vessel and jet propulsion system cantileverly mounted to the transom of a boat having a water tunnel or cavity integrally formed as a part of the boat structure. The turbojet pump assembly is cantileverly mounted on the aft portion of the transom and is connected by a drive shaft to the output of the drive engine of the boat. According to a preferred embodiment, a mounting member located between the transom and the drive engine also serves as an exhaust manifold housing.

13 Claims, 1 Drawing Sheet

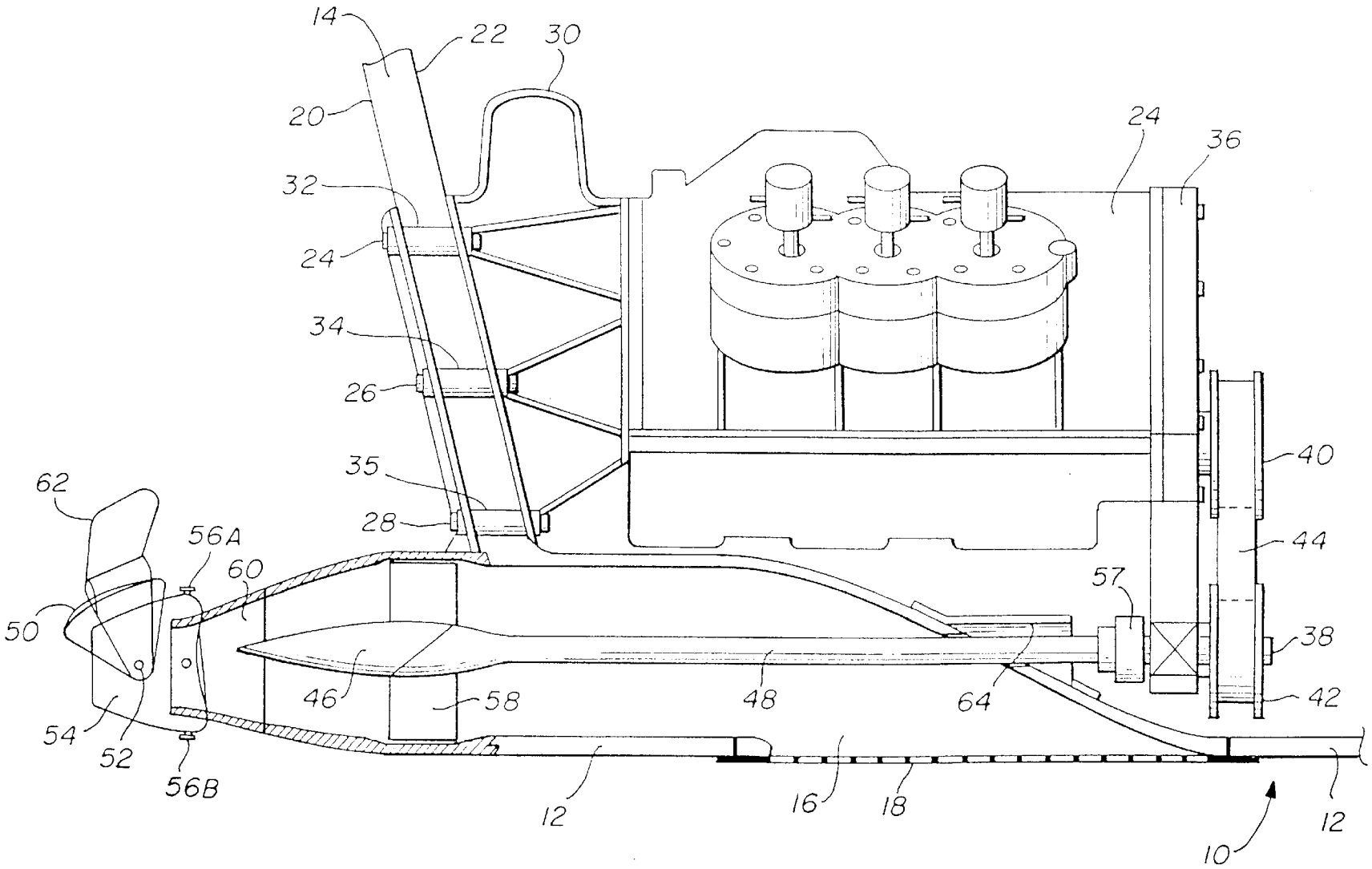
10
12
12
14
16
18
20
22
24
24
26
28
30
32
34
35
36
38
40
42
44
46
48
50
52
54
56A
56B
57
58
60
62
64

CANTILEVER JET DRIVE PACKAGE

BACKGROUND OF THE INVENTION

1. Field of the Invention

The present invention relates to a marine vessel having a water jet propulsion system, and more particularly, to such a system having a drive engine cantileverly supported by the transom and wherein the water inlet passage or tunnel is molded into the hull of the boat with a water turbine aft of the boat transom.

2. Description of Related Art Including Information Disclosed Under 37 CFR 1.97 and 1.98

Marine vessels driven by a water jet are not new. Neither is cantileverly supporting an engine on the transom of the stern of a boat new. For example, U.S. Pat. No. 3,259,099, issued to E. C. Kiekhaefer on Jul. 5, 1966, shows an inboard engine supported on a plate assembly which is cantileverly supported by the transom of the boat. The engine drive shaft passes through the transom to a propeller drive unit which drive unit can be rotated in a horizontal plane to provide steering of the boat.

U.S. Pat. No. 3,834,344, issued to Takao Yoshino on Sep. 10, 1974, also shows an engine cantileverly mounted to a boat transom. A rather large, circular hole is provided through the transom for controls and the engine drive shaft which runs to the boat propeller. The patent also discloses rubber mounting members for absorbing engine vibrations.

Also, U.S. Pat. No. 3,583,357, issued to William J. Shimanckas on Jun. 8, 1971, and assigned to the same assignee as the present invention, shows an engine and drive system combination mounted to the transom with a large hole therein for passage of the propeller drive unit and controls.

Another U.S. Pat. No. 3,083,679, issued to W. C. Conover on Apr. 2, 1963, shows the engine cantileverly mounted to stern support members which are adjacent the transom. The engine drive shaft passes through a hole in the transom to a propeller drive unit.

U.S. Pat. No. 3,929,089, issued to Ralph E. Lambrecht et al., and also assigned to the same assignee as the present invention, shows an engine which is partially supported in a cantileverly fashion by the transom, but also includes engine mounts attached to the bottom hull of the boat. A large hole defined in the transom provides a passage for the engine drive shaft.

U.S. Pat. No. 2,064,463, issued to P. Crosley, Jr., on Dec. 15, 1936, shows a boat having a metal hull including a metal bottom portion and a stern wall. A large hole is defined by the stern wall portion in the rearwardmost bottom portion. An engine mount covers the hole in the stern and bottom and includes a top portion for passage of a rudder control. The engine mount also includes a portion on which the engine is cantileverly mounted and which defines a passageway for the drive shaft which connects to the boat's propeller.

SUMMARY OF THE INVENTION

It is an object of the present invention to provide an efficient jet propulsion drive system for marine vessels.

Accordingly, the present invention discloses a marine vessel and jet propulsion system which comprises a vessel hull having a stern portion wherein the stern portion includes a transom member with inboard and aft faces. The stern portion also defines a water inlet passage or tunnel which in a preferred embodiment is molded into the boat hull. The transom defines a passage for providing a fluid connection from the water inlet passage to the aft face of the transom. The drive engine is cantileverly supported at the inboard face of the transom and the drive engine has a rearward portion and a forward portion with a power output. In a preferred embodiment, a drive plate assembly is connected to the power output shaft at the forward portion of the drive engine and in turn has a drive output below the engine. A turbojet pump assembly is in fluid connection with the transom passage and the water inlet tunnel and is mounted to the aft face of the transom at a location below the engine. A drive shaft connected to the turbojet pump extends between the turbojet pump and the drive output of the engine. The system further includes a mounting adaptor which is mounted to the inboard face of the transom and also to the rearward portion of the drive engine to provide proper spacing and support to the engine. In a preferred embodiment, the mounting adaptor is constructed so as to act as the exhaust manifold housing. Also included in the transom are rubber isolation mounts between the mounting adaptor bolts and the transom.

BRIEF DESCRIPTION OF THE DRAWING

These and other features of the present invention will be more fully disclosed when taken in conjunction with the following Detailed Description of the Preferred Embodiment(s) in which like numerals represent like elements and in which:

FIG. 1 is a plane view in partial cross section showing the water jet propulsion system of the present invention cantileverly mounted to the transom of the marine vessel.

DETAILED DESCRIPTION OF THE PREFERRED EMBODIMENT(S)

Referring now to the FIGURE, there is shown in cross section a hull 10 of a marine vessel having a bottom portion or hull 12 extending from the transom portion 14 to a forward bow of the boat (not shown). The bottom of the hull 12 defines a water inlet passage or tunnel 16 which may be covered by a removable grating or screen 18. Removable grating 18 is to prevent debris from entering the water passage 16 and thereby avoiding damage to the turbojet drive. As shown, the bottom of the boat hull 12 is attached to transom 14 in a fluid-tight manner. Further as shown, transom 14 includes an aft face 20 and a forward or inboard face 22. As shown, engine 24 may be any suitable power source such as a gasoline or diesel internal combustion engine. The engine also, of course, could be a 2-cycle or 4-cycle engine which has the necessary power for driving the boat. As shown, engine 24 is cantileverly mounted to the inboard face of transom 14 at several locations by bolts 24, 26, and 28. In a preferred embodiment, located between the engine 24 and transom 14, is a mounting adaptor or member 30 which is preferably designed to have a shape so as to assure that engine 24 is maintained in a horizontal position. Further, in the embodiment shown, the engine-mounting member 30 also serves as an exhaust manifold.

To help prevent vibrations of the engine being transmitted to the boat, rubber insolation mounts 32, 34, and 36 are included in the transom such that the bolts 24, 26, and 28 pass therethrough. Thus, it can be seen at this point, that the engine or power source 24 is cantileverly mounted to the transom 14. As shown, at the forward end of engine 24, there is included a drive plate assembly 36 which receives the power output of engine 24. Drive plate assembly 36 extends below the bottom of the engine 24 as shown and provides a drive output 38 at a point below the engine. It will be appreciated that the power output from engine 24 may be coupled to the drive output 38 by any suitable transmission technique, including a fixed ratio belt drive, such as indicated by pulleys 40 and 42 which are connected by belt 44. It will also be appreciated by those skilled in the art that a fixed ratio gear drive could readily be substituted for the fixed ratio belt drive. Further, it is also possible to use a changeable ratio gear drive or a continuous variable transmission for transferring the power from the power output of the engine 24 to the drive output 38. There may also be included in any of the above-mentioned drive techniques an electric clutch such that the engine and transmission include a neutral setting.

Also as shown, there is included a jet pump and impeller unit 46 which is cantileverly mounted to the aft face 20 of transom 14. A hole is defined in the transom 14 at the bottom portion of the transom to allow passage for an elongated drive shaft 48. Reverse gate 50 is shown as being pivotally mounted at pivot point 52 on the output nozzle 54. Controls (not shown) will also be included for activating reverse gate 50 and for pivotally rotating exhaust or thrust nozzle 54 at pivot points 56A and 56B.

Thus, in operation it would be appreciated that, when the engine 24 is operating and power is being transmitted to elongated drive shaft 48 from drive output 38 through vibration damping coupler 57, water will be drawn into the tunnel area or passage 16, past screen 18 and is then exhausted under pressure by means of impeller blades 58 of the turbojet pump. The water is exhausted through the turbo housing 60 into the steerable exhaust nozzle 54 such that it provides power to move the boat. It should be appreciated that reverse gate 50 also includes a rudder member 62 to help provide steering to the boat in addition to the rotating thrust nozzle.

Also as shown, there is a watertight seal member 64 for passage of the elongated drive shaft 48 through the hull of the boat.

In a preferred embodiment, the water passage 16, defined in the hull of the boat, is molded at the time the boat is cast, such as by sand casting.

The corresponding structures, materials, acts, and equivalents of all means or step plus function elements in the claims below are intended to include any structure, material, or act for performing the function in combination with other claimed elements as specifically claimed.

What is claimed is:

1. A marine vessel and jet propulsion system comprising:

a vessel hull having a stern portion, said stern portion including a transom with inboard and aft faces, said stern portion further defining a water inlet tunnel and said transom defining a passage therethrough, said transom passage being in fluid communication with said water inlet tunnel;

a drive source cantileverly supported at said inboard face of said transom and having a forward portion, a rearward portion and a power output;

turbojet pump assembly in fluid communication with said transom passage and said water inlet tunnel and mounted to said transom at a location below said drive source; and a drive shaft which couples said turbojet pump assembly to said power output of said drive source.

2. The marine vessel and system of claim 1 and further including a drive plate assembly connected to said power output of said drive source and having a drive output below said source.

3. The marine vessel and system of claim 1 and further comprising a mounting adapter mounted to said inboard face of said transom, and wherein said rearward portion of said drive source is mounted to said mounting adaptor.

4. The marine vessel and system of claim 3, wherein said drive source is an internal combustion engine and whereas said mounting adaptor and said engine are connected such that said mounting adaptor is hollow adjacent said engine.

5. The marine vessel and system of claim 4, further comprising a plurality of mounting bolts penetrating said transom and a plurality of isolation mounts respectively between said mounting bolts and said transom.

6. The marine vessel and system of claim 1 wherein said water inlet tunnel is an integrally molded portion of said vessel hull.

7. The marine vessel and system of claim 1 and further comprising a removable water grating covering said water inlet tunnel.

8. The marine vessel and system of claim 2 wherein said drive plate assembly includes a first pulley connected to said power output of said drive source, a second pulley connected to said drive output, and a drive belt connected between said first and second pulleys.

9. The marine vessel and system of claim 1 wherein said drive source is an internal combustion engine and further including a drive plate assembly connected to said power output of said internal combustion engine and having a drive output below said engine.

10. The marine vessel and system of claim 9 and further comprising a mounting adapter mounted to said inboard face of said transom, and wherein said rearward portion of said internal combustion engine is mounted to said mounting adaptor.

11. The marine vessel and system of claim 9, further comprising a plurality of mounting bolts penetrating said transom and a plurality of isolation mounts respectively between said mounting bolts and said transom.

12. The main vessel and system of claim 11 wherein said water inlet tunnel is an integrally molded portion of said boat hull.

13. The marine vessel and system of claim 12 and further comprising a removable water grating covering said water inlet tunnel.

* * * * *